US007467739B2

(12) United States Patent
Fujisawa et al.

(10) Patent No.: US 7,467,739 B2
(45) Date of Patent: Dec. 23, 2008

(54) COMBUSTION-POWERED, FASTENER-DRIVING TOOL GENERATING SPARKS IN SUCCESSION WHEN TRIGGERED

(75) Inventors: Haruhisa Fujisawa, Hitachinaka (JP); Yoshitaka Akiba, Hitachinaka (JP); Nobuhiro Takano, Hitachinaka (JP); Kenro Ishimaru, Hitachinaka (JP); Tomomasa Nishikawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 171 days.

(21) Appl. No.: 11/237,860

(22) Filed: Sep. 29, 2005

(65) Prior Publication Data

US 2006/0065690 A1 Mar. 30, 2006

(51) Int. Cl.
*B25C 1/08* (2006.01)

(52) U.S. Cl. ..... 227/10; 227/2; 227/156; 227/9

(58) Field of Classification Search ..... 227/10, 227/2, 156, 9
See application file for complete search history.

(56) References Cited

U.S. PATENT DOCUMENTS

| | | | | |
|---|---|---|---|---|
| 4,522,162 | A | 6/1985 | Nikolich | |
| 5,133,329 | A | 7/1992 | Rodseth et al. | |
| 5,197,646 | A | 3/1993 | Nikolich | |
| 5,415,136 | A | 5/1995 | Doherty et al. | |
| 5,752,643 | A | 5/1998 | MacVicar | |
| 5,873,508 | A * | 2/1999 | MacVicar et al. | 227/10 |
| 6,123,241 | A * | 9/2000 | Walter et al. | 227/8 |
| 6,213,370 | B1 * | 4/2001 | Walter | 227/8 |
| 6,223,963 | B1 * | 5/2001 | Aparacio, Jr. | 227/8 |
| 6,247,626 | B1 * | 6/2001 | MacVicar | 227/10 |
| 6,311,887 | B1 * | 11/2001 | Walter | 227/10 |
| 6,318,615 | B1 * | 11/2001 | Walter | 227/10 |
| 6,779,493 | B2 * | 8/2004 | Doherty et al. | 123/24 A |
| 7,021,251 | B2 * | 4/2006 | Ohmori et al. | 123/46 R |
| 2004/0182336 | A1 * | 9/2004 | Ohmori et al. | 123/46 R |
| 2005/0001002 | A1 * | 1/2005 | Schiestl et al. | 227/10 |
| 2006/0266785 | A1 * | 11/2006 | Moeller et al. | 227/8 |

FOREIGN PATENT DOCUMENTS

| | | |
|---|---|---|
| EP | 1 459 850 | 9/2004 |

* cited by examiner

*Primary Examiner*—Brian D Nash
(74) *Attorney, Agent, or Firm*—Antonelli, Terry, Stout & Kraus, LLP.

(57) ABSTRACT

A combustion-powered, fastener-driving tool includes a cylinder and a combustion chamber disposed on top of the cylinder that accommodates a gaseous mixture of existing air in the combustion chamber and fuel injected therein. A spark plug generates a spark to combust the gaseous mixture in the combustion chamber. A trigger produces the spark in the spark plug when operated. A piston is movably supported in the cylinder and driven by combustion in the combustion chamber. A driving blade is coupled to the piston for driving a fastener. A spark controller is provided for generating a plurality of sparks in succession with the spark plug.

14 Claims, 8 Drawing Sheets

COMBUSTION-POWERED, FASTENER-DRIVING TOOL GENERATING SPARKS IN SUCCESSION WHEN TRIGGERED

BACKGROUND OF THE INVENTION

1. Field of the Invention

The present invention relates to a combustion-powered, fastener-driving tool for driving fasteners, such as nails, rivets, or staples. The combustion-powered, fastener-driving tool includes a cylinder in the top section of which is formed a combustion chamber. The combustion-powered, fastener-driving tool generates a motive force for driving a piston in the cylinder by igniting a mixture of air and a flammable gas in the combustion chamber.

2. Description of the Related Art

Conventional combustion-powered, fastener-driving tools is disclosed, for example, in U.S. Pat. Nos. 5,197,646 and 4,522,162. Such conventional combustion-powered, fastener-driving tools typically include a housing serving as the main enclosure of the tool, a cylinder accommodated in the housing, a piston disposed in the cylinder and guided by the cylinder to move vertically in a reciprocating motion, a driving blade fixed to the piston for driving a fastener into a workpiece when the piston moves in a downward operation, a combustion chamber frame provided in the housing that slides vertically while guided by the periphery of the cylinder, the combustion chamber frame forming a combustion chamber having walls defined by the combustion chamber frame and the piston when the combustion chamber frame is moved upward, an injection opening for injecting a flammable gas from a gas cylinder accommodated in a grasping portion or a handle into the combustion chamber, a fan provided in the combustion chamber, a spark plug for igniting a mixture of air and the flammable gas injected into the combustion chamber, a trigger mounted on the handle, and an ignition system electrically connected to the trigger for producing a spark in the spark plug when the trigger is operated.

The combustion-powered, fastener-driving tool having this construction supplies a mixture of the flammable gas from the gas cylinder mounted on the housing and air to the combustion chamber. The combustion-powered, fastener-driving tool generates a spark with the spark plug in the combustion chamber when the trigger is operated to detonate the mixture in the combustion chamber. The resulting explosion generates a driving force for driving a nail or other fastener. Unlike a compressed-air, fastener-driving tool that uses compressed air as a driving source, this combustion-powered, fastener-driving tool requires no compressor and is, therefore, much easier to transport to a construction site or the like. Further, the combustion-powered, fastener-driving tool can be conveniently provided with an internal power source, such as a battery, so that the tool can be used in any environment without requiring a commercial power supply.

FIG. 10 shows the ignition ratio with respect to the concentration of fuel in the combustion chamber (ratio of flammable gas to the total volume of the combustion chamber) for the conventional combustion-powered, fastener-driving tool. The result shown in FIG. 10 is obtained at a circumstance where the external temperature of the tool is maintained at constant, such as 25° C., and when the same type of fuel is used and the spark intensity of the spark plug is maintained at constant. Inventors have found that the ignition ratio varies depending primarily on the gas type, temperature, and spark intensity.

As shown in FIG. 10, the ignition ratio is 100% when the gas concentration is within a specific range (hereinafter, this range will be referred to as a "gas concentration band"). The gas concentration band in the example of FIG. 10 is the range of 3.4-6.5%. The mixture of liquefied gas and air in the combustion chamber in this gas concentration band ignites reliably.

However, a spark from the spark plug cannot reliably ignite a gas concentration outside of the gas concentration band, that is, when the ignition ratio is less than 100%. In fact, the gas in the combustion chamber does not ignite at all when the concentration of gas separates farther from the upper or lower limits of the gas concentration band. Hence, there is a demand to expand this gas concentration band at which the ignition ratio is 100% in order to ensure stable ignition.

However, the amount of liquid injected from the gas cylinder is easily influenced by temperature inside the faster-driving tool or external air temperature. Such changes in the amount of liquid gas injected at a low temperature or a high temperature may result in a gas concentration outside of the gas concentration band, making it impossible to ignite the mixture reliably. This unreliable ignition is likely due primarily to a flameout phenomenon in which the electrode of the spark plug robs the heat from the spark.

SUMMARY OF THE INVENTION

In view of the foregoing, it is an object of the present invention to provide a combustion-powered, fastener-driving tool capable of producing reliable sparks by preventing this flameout phenomenon and increasing the opportunities of ignition by expanding the gas concentration range in which the fuel can be stably ignited or burned.

It is another object of the present invention to obtain a gas concentration range that does not depend on temperature.

The following is a general description of representative combustion-powered, fastener-driving tools disclosed in this specification, wherein the combustion-powered, fastener-driving tool according to the present invention is assumed to be disposed in an orientation in which a fastener is fired vertically downward against a workpiece.

According to one aspect of the present invention, a combustion-powered, fastener-driving tool includes: a housing; a cylinder fixedly disposed in the housing; a combustion chamber disposed on top of the cylinder, the combustion chamber accommodating a gaseous mixture of existing air in the combustion chamber and fuel injected therein; a spark plug that is disposed in the combustion chamber and generates a spark to combust the gaseous mixture in the combustion chamber; a trigger that produces the spark in the spark plug when operated; a piston movably supported in the cylinder and driven by combustion in the combustion chamber; a driving blade coupled to the piston for driving a fastener; and a spark controller that generates a plurality of sparks in succession with the spark plug.

The combustion-powered, fastener-driving tool as defined above may further include a temperature sensor that detects a tool temperature. The tool temperature indicates the temperature of the fastener-driving tool primarily increased by heat generated in the combustion chamber. The spark controller varies the number of sparks generated in the spark plug based on the temperature detected by the temperature sensor.

The spark controller may control the spark plug to generate a first predetermined number of sparks when the tool temperature is within a predetermined range, a second predetermined number of sparks when the tool temperature is lower than lowest temperature in the predetermined range, and a third predetermined number of sparks when the tool temperature is higher than highest temperature in the predetermined range, wherein the second predetermined number and the third predetermined number are greater than the first predetermined number.

Preferably, the spark controller includes a spark capacitor charging circuit, and a spark energy accumulating capacitor connected to the spark capacitor charging circuit. The spark energy accumulating capacitor supplies energy to the spark plug to generate the spark, wherein the spark capacitor charging circuit varies a charge time for charging the spark energy accumulating capacitor based on the number of sparks to be generated.

It is also preferable that the spark controller include a combustion sensor that is disposed in the housing, detects occurrence of combustion of the gaseous mixture in the combustion chamber, and outputs a detection signal indicative of occurrence of combustion, and that the spark controller cancel the generation of sparks with the spark plug when the combustion sensor outputs the detection signal.

Since the combustion-powered, fastener-driving tool of the present invention generates a plurality of sparks in the spark plug when the trigger is operated, the combustion-powered, fastener-driving tool can expand the gas concentration range, that is, the gas concentration band at which a reliable ignition ratio is obtained. Accordingly, stable ignition or combustion can be achieved at low temperatures or high temperatures.

By reducing the number of generated sparks based on the temperature, or varying the amount of consumed energy required for generating sparks, based on the number of sparks to be generated, the combustion-powered, fastener-driving tool of the present invention can reduce unnecessary power consumption in the battery, which is mounted in the combustion-powered, fastener-driving tool.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A combustion-powered, fastener-driving tool according to a preferred embodiment of the invention will be described with reference to the accompanying drawings. Hereinafter, the terms "upward", "downward", "upper", "lower", "above", "below", "beneath" and the like will be used throughout the description assuming that the combustion-powered, fastener-driving tool is disposed in an orientation in which it is used as shown in FIGS. 1 and 2.

Figure 1:
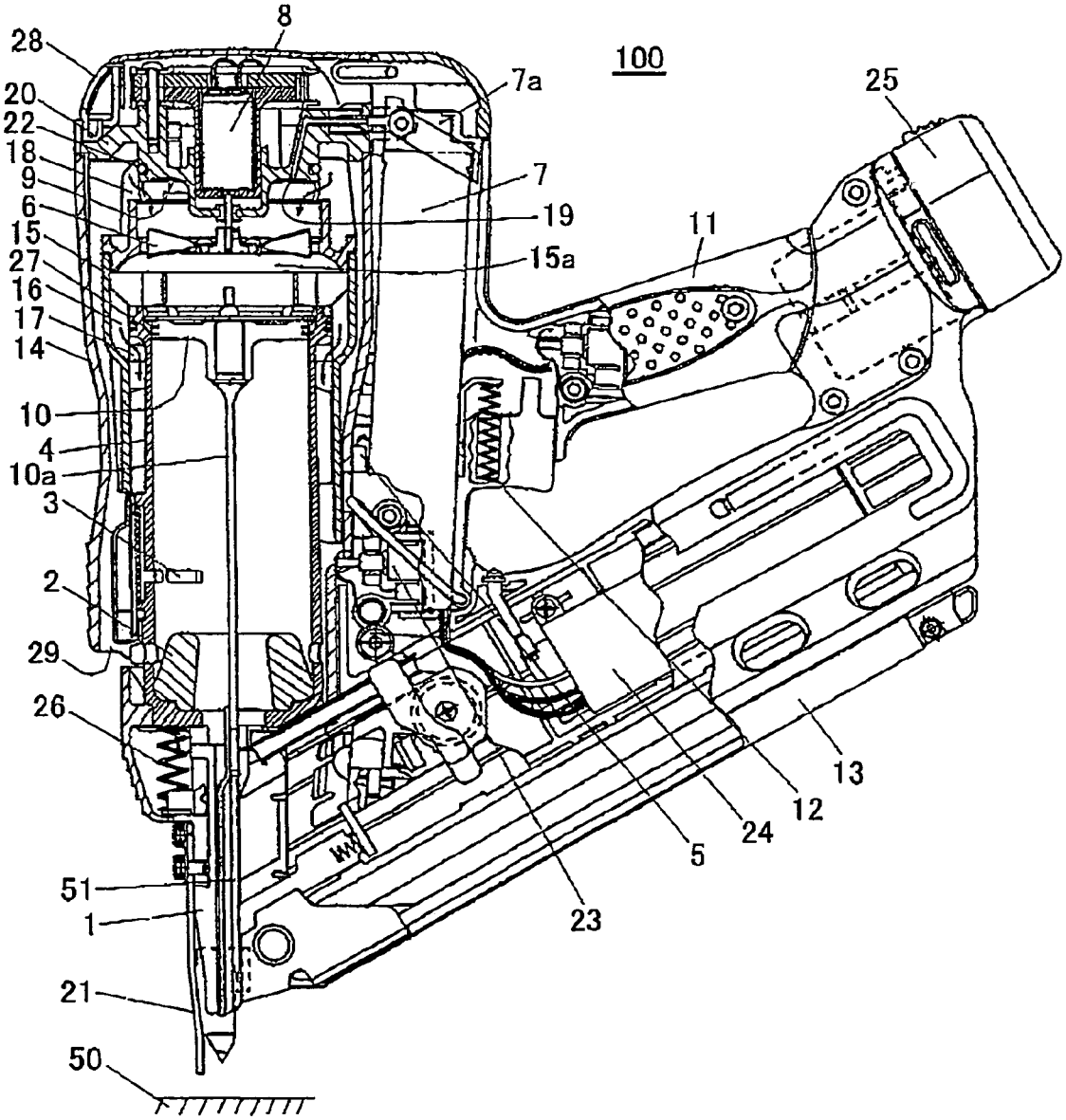
FIG. 1 is a cross-sectional view of a combustion-powered, fastener-driving tool according to a preferred embodiment of the present invention, when the tool is in an initial state.
Figure 2:
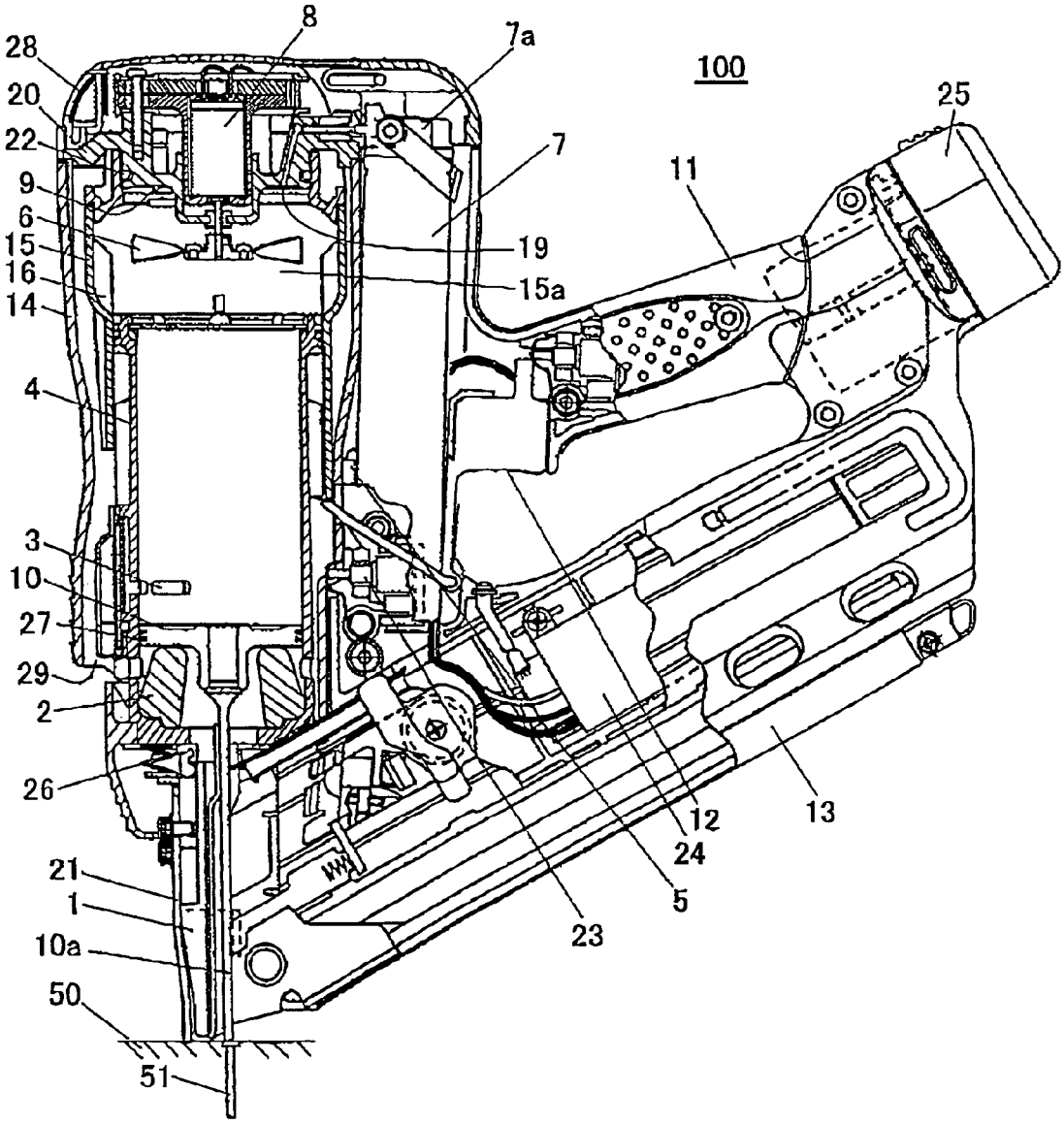
FIG. 2 is a cross-sectional view of a combustion-powered, fastener-driving tool according to a preferred embodiment of the present invention, when the tool is in an operating state.

FIGS. 1 and 2 are cross-sectional views showing a combustion-powered, fastener-driving tool 100, and particularly a nail-driving tool. FIG. 1 shows the fastener-driving tool 100 when a piston 10 is positioned in an initial states while FIG. 2 shows the combustion-powered, fastener-driving tool when the piston 10 is in a bottom dead center. The components and operations of the nail-driving tool are described below with reference to FIGS. 1 and 2.

As shown in FIG. 1, the fastener-driving tool 100 includes a housing 14 that forms a framework of the fastener-driving tool 100 for accommodating the primary components of the tool. These components include a cylinder 4, a bumper 2, a piston 10, a driving blade 10*a* coupled to the piston 10, a fan 6, a motor 8, a spark plug 9, an injection opening 19, a gas cylinder 7, a combustion chamber frame 15, and a head cover 20. Incidental parts, including a handle 11, a tail cover 1, a push lever 21, a magazine 13, and a trigger 12 are mounted on the housing 14.

The magazine 13 mounted on the housing 14 includes a spark controller 24. The spark controller 24 is electrically connected to such components as the trigger 12, a push switch 23, and a temperature sensor 5 in order to receive electrical signals generated by these components for controlling the charging of a spark energy accumulating capacitor (spark capacitor) C2 described later and for controlling the generation of sparks in the spark plug 9, as well as for starting and controlling the motor 8, which drives the fan 6. The spark controller 24 is also electrically connected to a battery 25, such as a Ni—Cd battery that is mounted in a holder (not shown) provided in part of the handle 11. The battery 25 supplies power to the spark controller 24.

The cylinder 4 and the head cover 20 are internally disposed in the housing 14 and fixed thereto. However, the combustion chamber frame 15 is coupled with the push lever 21 disposed in the bottom of the cylinder 4 and is guided by the housing 14 and the cylinder 4. A spring 26 urges the combustion chamber frame 15 downward in the drawing, that is, in a direction for driving a nail 51, serving as the fastener in the preferred embodiment. Hence, the combustion chamber frame 15 is capable of moving axially with respect to the housing 14.

When the push lever 21 is pressed against a workpiece 50, such as a wood material, the push lever 21 opposes the urging force of the spring 26 and the combustion chamber frame 15 moves above the cylinder 4, forming a combustion chamber 15*a*. Specifically, the combustion chamber 15*a* is a space enclosed by the combustion chamber frame 15, the head cover 20, and the piston 10, in which a mixture of a combustion gas and air is burned. In order to form a hermetically sealed combustion chamber 15*a*, a seal member 22, such as an O-ring, is interposed between the upper end of the cylinder 4 and the lower end of the head cover 20.

A slidable seal member 27 is provided around the piston 10 so that the piston 10 can move vertically within the cylinder 4. Provided below the cylinder 4 are an exhaust hole 3, a check valve (not shown) for opening and closing the exhaust hole 3, and the bumper 2 against which the piston 10 collides. When the piston 10 abruptly moves to its bottom dead point to drive the nail 51 and collides with the bumper 2, the bumper 2 deforms to absorb excess energy in the piston 10.

The combustion chamber 15*a* accommodates the fan 6, which can be rotated by the motor 8 disposed above the head cover 20; the spark plug 9 for generating a spark when the trigger 12 is operated; and the injection opening 19 for injecting flammable gas into the combustion chamber 15*a* from the gas cylinder 7, which stores this flammable gas (liquid gas). Fins 16 are also provided around the inner periphery of the combustion chamber 15*a* as ribs that protrude radially inward.

The magazine 13 and the tail cover 1 are mounted below the housing 14. The magazine 13 is filled with a plurality of the nails 51. The tail cover 1 guides the nails 51 supplied from the magazine 13 and sequentially sets the nails 51 beneath the piston 10.

In the static state shown in FIG. 1, the push lever 21 is urged by the spring 26 to protrude lower than the bottom end of the tail cover 1. At this time, a gap 17 is formed above the top end of the cylinder 4 and below the combustion chamber frame 15, which is coupled with the push lever 21, and another gap 18 is formed between the top end of the combustion chamber frame 15 and the bottom of the head cover 20. The piston 10 is halted in its top dead center in the cylinder 4.

If a user grips the handle 11 and pushes the end of the push lever 21 against the workpiece 50 when the fastener-driving tool 100 is in this state, the push lever 21 moves upward against the opposing force of the spring 26, causing the combustion chamber frame 15, which is coupled to the push lever 21, to rise to the position shown in FIG. 2. Raising the combustion chamber frame 15 to this position closes the gaps 17 and 18 above and below the combustion chamber frame 15 and forms the combustion chamber 15*a*, which is hermetically sealed by the seal member 22 and thus closed off from the external air.

As shown in FIG. 2, the gas cylinder 7 (fuel tank) is subsequently pressed in association with the operation of the push lever 21, causing flammable gas to be injected through the injection opening 19 into the combustion chamber 15*a*. Further, when the push switch 23 detects that the combustion chamber frame 15 is positioned in its top dead center, the drive circuit of the motor 8 is turned on and the motor 8 drives the fan 6 to rotate. The flammable gas injected into the combustion chamber 15*a* is agitated and mixed with air in the combustion chamber 15*a* by the fan 6 rotating within the hermetically sealed combustion chamber 15*a* in cooperation with the fins 16 protruding inside the combustion chamber 15*a*. Here, the flammable gas stored in the gas cylinder 7 is a pressurized, liquid gas that becomes gasified when injected into the combustion chamber 15*a*. A measuring valve 7*a* is provided on the top end of the gas cylinder 7 for adjusting the amount of gas injected from the gas cylinder 7 through the injection opening 19.

After pressing the push lever 21 against the workpiece 50, the user then pulls the trigger 12 provided on the handle 11 to activate the spark controller 24. At this time, the spark controller 24 controls the spark plug 9 to produce a plurality of sparks in succession for igniting and burning the gaseous mixture. The combusted gas expands to move the piston 10 downward and strike the nail 51 in the tail cover 1. FIG. 2 shows the position of the piston 10 after striking the nail 51.

An important aspect of the present invention is that operating the trigger 12 once produces a plurality of sparks from the spark plug 9 to ensure stable ignition, For example, the number of sparks generated successively can be set to three. The operations of the spark controller 24 for controlling the number of generated sparks will be described later.

After striking the nail 51, the piston 10 contacts the bumper 2, and the combusted gas is discharged from the cylinder 4 via the exhaust hole 3. As described above, a check valve is disposed in the exhaust hole 3. This check valve is closed after the combusted gas has been discharged from the cylinder 4 and at the point that the interior of the cylinder 4 and the combustion chamber 15*a* have reached atmospheric pressure. While the gas remaining in the cylinder 4 and the combustion chamber frame 15 has just been combusted and is high in temperature, the heat from the combusted gas is absorbed by the inner walls of the cylinder 4 and combustion chamber frame 15 and by the fins 16 and the like, thereby rapidly cooling the gas. As a result, the pressure in the combustion chamber 15*a* drops to atmospheric pressure or below (thermal vacuum) and the piston 10 is drawn back to its initial top dead center.

When the user subsequently releases the trigger 12 (turns the trigger 12 off) and lifts the tool, the push lever 21 separates from the workpiece 50, allowing the push lever 21 and the combustion chamber frame 15 to move downward by the urging force of the spring 26 and return to the position shown in FIG. 1. At this time, the spark controller 24 controls the fan 6 to continue rotating for a prescribed time, even when the push switch 23 is off.

In the state shown in FIG. 1, the gaps 17 and 18 exist above and below the combustion chamber frame 15 so that the combustion chamber 15*a* is not hermetically sealed. In this state, the rotating fan 6 draws fresh air through an inlet 28 formed in the top surface of the housing 14 and exhausts residual gas out through an outlet 29 formed in the bottom of the housing 14, thereby scavenging the air in the combustion chamber 15*a*. After a prescribed time, the fan 6 stops rotating, and the fastener-driving tool 100 is returned to its initial state.

As described above, a feature of the present invention is that the spark controller 24 controls the spark plug 9 to generate a plurality of sparks in succession. In order to ensure stable ignition with the spark plug, the spark controller 24 according to the present invention has the structure described below.

Figure 3:
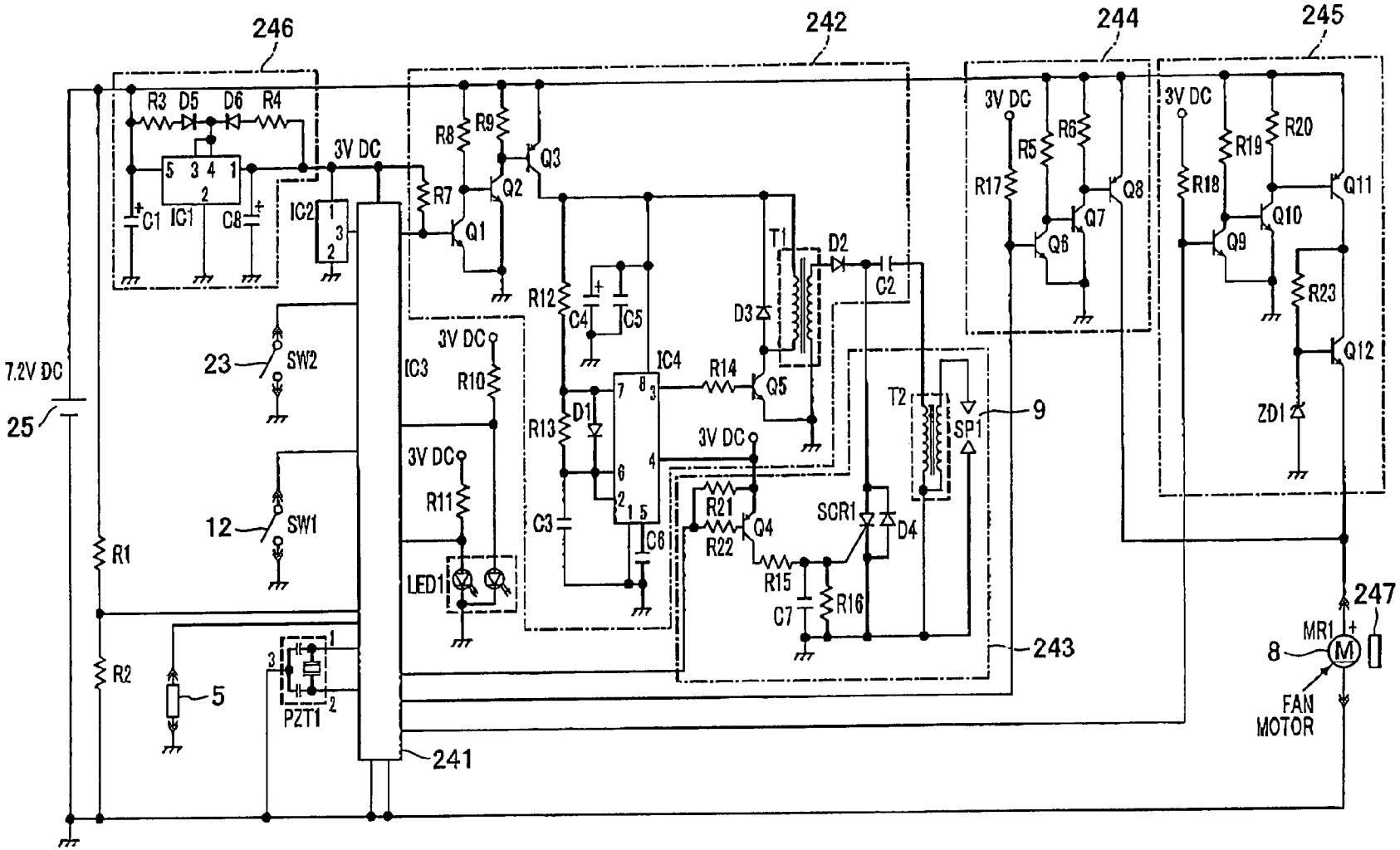
FIG. 3 is a circuit diagram for a spark controller employed in the combustion-powered, fastener-driving tool of the preferred embodiment.

FIG. 3 is a circuit diagram of the spark controller 24 according to the preferred embodiment. In order to control sparks generated by the spark plug 9, the spark controller 24 includes a computation control IC 241 (microcomputer), a spark capacitor charging circuit 242, and a spark circuit 243. The spark controller 24 also includes a motor drive circuit 244 and a motor regular operation circuit 245 for driving the motor 8 to agitate air and flammable gas in the combustion chamber 15*a* or to expel the combusted gas from the combustion chamber 15*a*. The spark controller 24 is also provided with a power circuit 246 for supplying a low voltage (3 V, for example) that is lower than the voltage of the battery 25 (7.2 V, for example) in order to supply power to the computation control IC 241 and to supply a bias voltage and the like to a transistor Q4 and a light-emitting diode LED1.

The computation control IC 241 has an external crystal oscillator PZT1 for generating a clock signal required by the computation control IC 241 itself as a timing signal. The computation control IC 241 receives such control input signals as an ON signal from the trigger 12, an ON signal from the push switch 23, and a detection signal from the temperature sensor 5 and outputs control signals required for input stage transistors in the spark capacitor charging circuit 242, spark circuit 243, motor drive circuit 244, and motor regular operation circuit 245 to control the operations of these circuits. The computation control IC 241 is also electrically connected to a power source control circuit IC2 and halts output from this circuit when output from the power circuit 246 is less than or equal to a prescribed voltage.

The spark capacitor charging circuit 242 includes transistors Q1-Q3 forming switch circuits, a booster coil T1, a chopper switch transistor Q5, and a drive signal generating circuit (oscillator) IC4 for outputting a drive signal to the chopper switch transistor Q5. Through the switching operation of the chopper switch transistor Q5, the spark capacitor charging circuit 242 generates a voltage higher than that of the battery 25 (7.2 V) in the secondary winding of the booster coil T1. This voltage charges the spark energy accumulating capacitor C2 via a diode D2 as a voltage having a single polarity. The charge voltage of the spark energy accumulating capacitor C2 is 150 V, for example.

The spark circuit 243 includes a spark coil T2 having a primary winding connected in series to the spark energy accumulating capacitor C2, a discharge thyristor SCR1 provided for discharging the charge voltage of the spark energy accumulating capacitor C2 through the primary winding of the spark coil T2, and the drive transistor Q4 for supplying a spark signal having a prescribed pulse width to a gate of the discharge thyristor SCR1. The computation control IC 241 forms and supplies a spark signal having the prescribed pulse width for driving the transistor Q4 when the trigger 12 is turned on.

After the spark energy accumulating capacitor C2 has been charged to the prescribed voltage, such as 150 V, the computation control IC 241 supplies the spark signal (conducting pulse signal) to the gate of the discharge thyristor SCR1, so that the discharge thyristor SCR1 becomes electrically conductive. Accordingly, the charge in the spark energy accumulating capacitor C2 is discharged via the discharge thyristor SCR1 and the primary winding of the spark coil T2. As a result, a high voltage of 15 KV, for example, is induced in the secondary winding of the spark coil T2, and this high voltage generates a spark in the spark plug. A feature of the present invention is that a plurality of sparks is generated successively in the spark plug when the trigger 12 is operated. The number of sparks that are generated successively is increased if the temperature in the operating environment is low or high with respect to a predetermined temperature.

Figure 4:
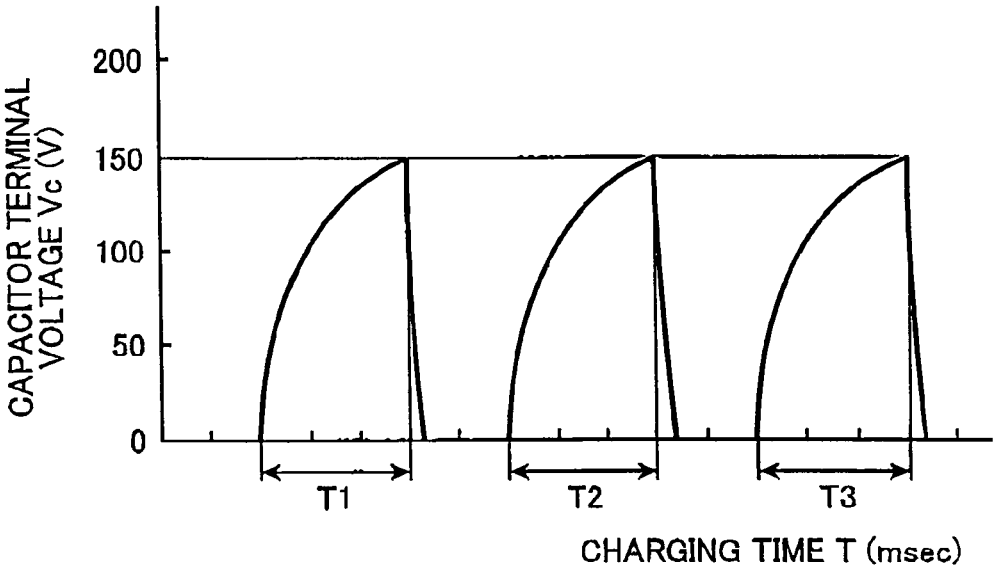
FIG. 4 is a graph illustrating charge voltage waveforms of a spark capacitor used in the combustion-powered, fastener-driving tool of the preferred embodiment.

Next, a sample operation of the fastener-driving tool 100 will be described for the case of generating three sparks. FIG. 4 shows a terminal voltage (charge voltage) Vc for charging the spark energy accumulating capacitor C2 in the operations of the fastener-driving tool 100 having the construction described above when the user presses the push lever 21 against the workpiece 50 and subsequently pulls the trigger 12.

The operations for obtaining the charge waveform shown in FIG. 4 will be described next. When the trigger 12 is turned on, the computation control IC 241 outputs a LOW level control signal to the transistor Q1 for a prescribed time. This control signal turns the transistor Q1 off, turns the transistors Q2 and Q3 on, and supplies power to the drive signal generating circuit IC4. The drive signal generating circuit IC4 generates a drive pulse (a pulse of 30 KHz, for example) in a terminal 3, driving the switch transistor Q5 on and off. By operating the switch transistor Q5 on and off, a voltage greater than the power voltage (150 V, for example) is generated in the secondary winding of the booster coil T1 for charging the spark energy accumulating capacitor C2 via the diode D2. A time T1 in FIG. 4 is the time required for charging the spark energy accumulating capacitor C2. This time T1 is set to 50 msec, for example.

After the charging time T1 has elapsed, the computation control IC 241 outputs a LOW level control signal to the base of the transistor Q4 for a prescribed time (10 msec, for example). This control signal turns the transistor Q4 on, and supplies a current to the gate of the discharge thyristor SCR1 for turning the discharge thyristor SCR1 on. When the discharge thyristor SCR1 is turned on, the accumulated charge in the spark energy accumulating capacitor C2 is discharged via the discharge thyristor SCR1 and the primary winding of the spark coil T2, inducing a high voltage, such as 15 KV, in the secondary winding of the spark coil T2 and generating a spark in the spark plug 9 due to the high voltage.

When the discharge thyristor SCR1 discharges the energy accumulated in the spark energy accumulating capacitor C2, characteristics caused by a decline in anode voltage returns the discharge thyristor SCR1 to an off state. After the computation control IC 241 has output the control signal to the base of the transistor Q4 for the prescribed time (10 msec), the computation control IC 241 changes the control signal to the HIGH level, turning off the transistor Q4.

Hereafter, similar operations of the spark controller 24 are applied to the spark energy accumulating capacitor C2 for a second charging time T2 and a third charging time T3. After each of the charging times T2 and T3 elapses, the discharge thyristor SCR1 is turned on to generate a spark in the spark plug 9.

Figure 5:
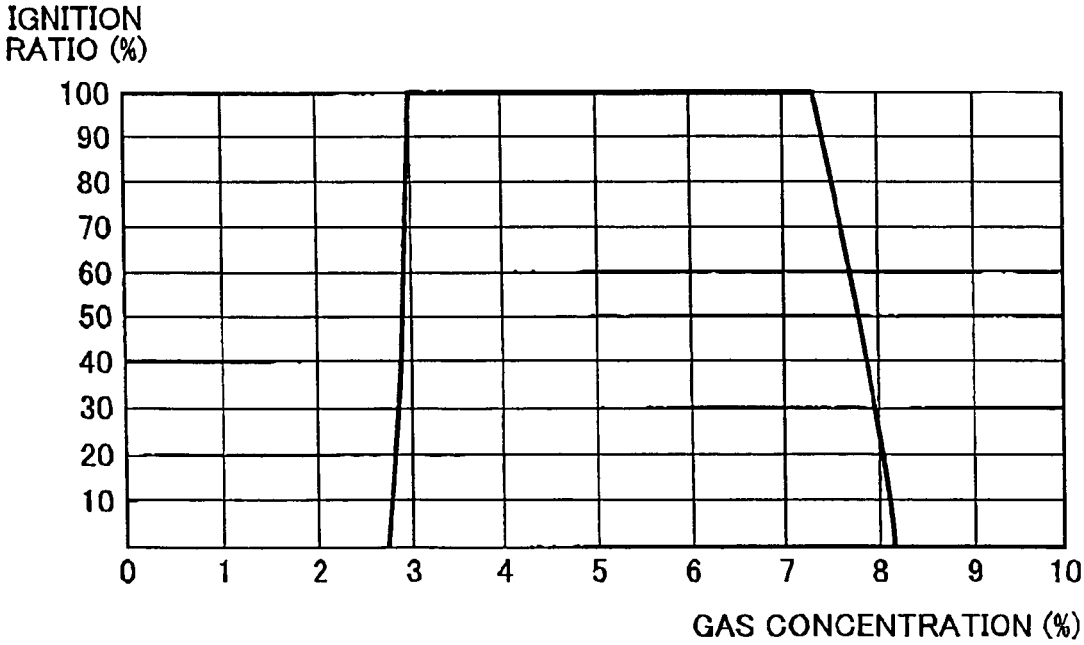
FIG. 5 is a graph showing the relationship of the ignition ratio and gas concentration for the combustion-powered, fastener-driving tool of the preferred embodiment.

FIG. 5 shows the relationship of the gas concentration and ignition ratio for fuel in the combustion chamber 15*a* for the combustion-powered, fastener-driving tool of the preferred embodiment when the spark plug is made to generate three sparks in succession. The characteristics in FIG. 5 were obtained with fixed tool temperature (25° C.), type of gas, and intensity of the sparks.

As described above, the gas concentration band is the range in which the ignition ratio is 100%. As shown in FIG. 5, the gas concentration band for the combustion-powered, fastener-driving tool of the preferred embodiment was expanded to a range from 3.0 to 7.3% from the conventional range of 3.4 to 6.5%. Since the fuel gas in the gas concentration band is ignited and burned reliably, the obtained range of stable ignition is better than the conventional range. Here, the number of sparks can be set to an optimal number by considering the type of fuel gas and the size of the spark plug electrode.

With this type of combustion-powered, fastener-driving tool, the combustion-powered, fastener-driving tool must prevent unnecessary power consumption since the driving source is a battery. Therefore, in the preferred embodiment of the present invention, the temperature sensor 5 is preferably used to vary the number of sparks by steps. While it is more effective to position the temperature sensor 5 as near the combustion chamber 15*a* as possible, the temperature sensor 5 need not be placed in the area for accommodating the gas cylinder 1, but may instead be placed on the top surface of the head cover 20, a side surface of the cylinder 4, or the like. The temperature sensor 5 detects the temperature of the fastener-driving tool 100 primarily increased by heat generated in the combustion chamber 15*a*.

Figure 6:
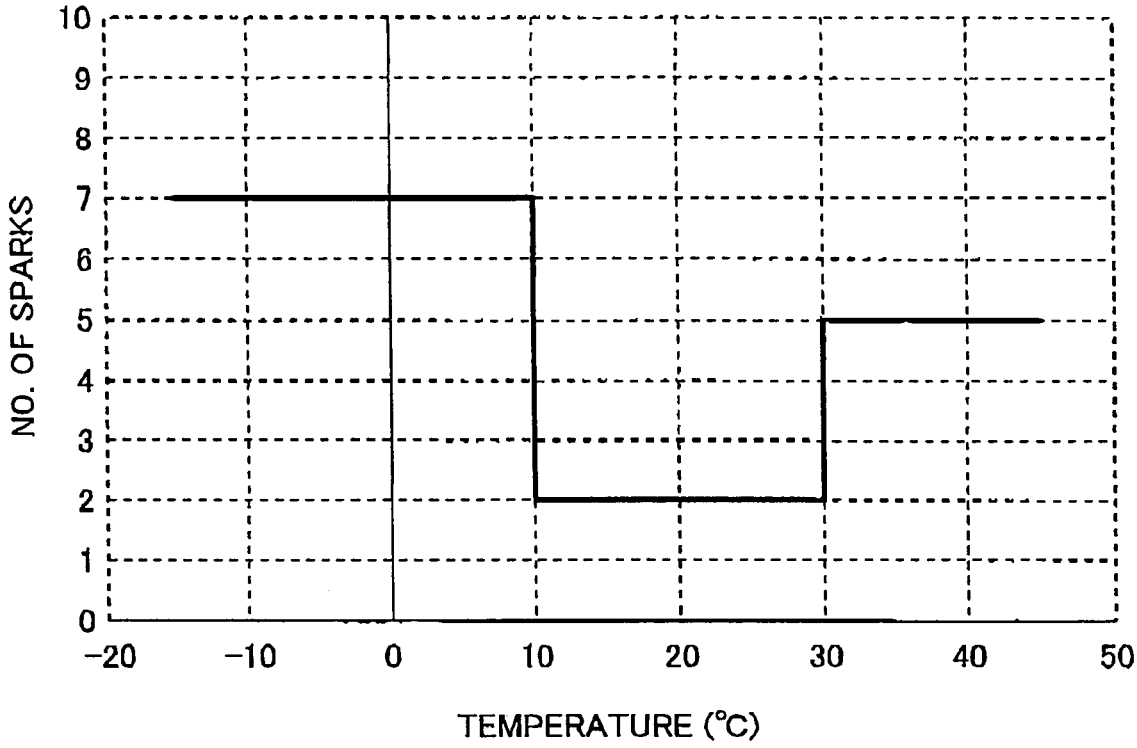
FIG. 6 is a graph showing the relationship between number of sparks and temperature for the combustion-powered, fastener-driving tool of the preferred embodiment.

FIG. 6 shows an example in which the control of the spark controller 24 varies the number of generated sparks based on the temperature of the fastener-driving tool 100. For example, the spark controller 24 can control the number of sparks at seven times when the temperature of the fastener-driving tool

100 is less than 10° C., two times when the temperature is in the range 10-30° C., and five times when the temperature exceeds 30° C.

Figure 7:
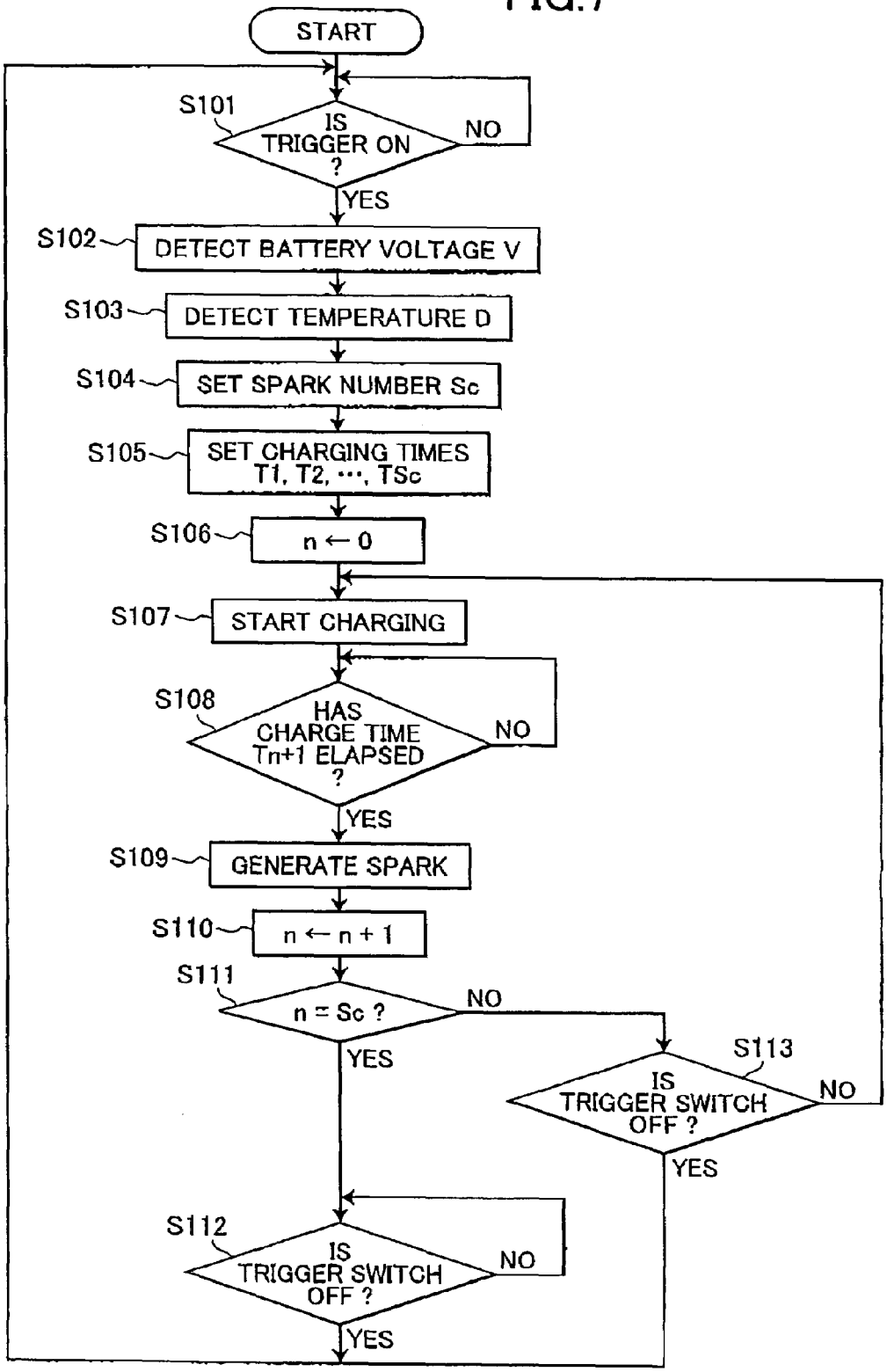
FIG. 7 is a flowchart illustrating steps in a process performed by a spark controller according to the preferred embodiment.

FIG. 7 is a flowchart showing steps in the control process of the spark controller 24 when varying the number of generated sparks based on the temperature detected by the temperature sensor 5. Next, the steps in the flowchart in FIG. 7 will be described.

Prior to beginning the control operation, the battery 25 must be inserted in the fastener-driving tool 100 so that the fastener-driving tool 100 is operable. At the beginning of the control process in S101, the spark controller 24 determines whether the trigger 12 is on. If the trigger 12 is on (S101: YES), then the process advances to S102.

In S102 the spark controller 24 detects the battery voltage V. In S103 the temperature sensor 5 detects the temperature of the fastener-driving tool 100. In S104 the spark controller 24 determines the number of sparks to be generated based on the relationship of the temperature and the number of sparks shown in FIG. 6.

In S105 the spark controller 24 sets charging times T1, T2, T3, and the like for charging the spark energy accumulating capacitor C2 for each spark. In S106 the spark controller 24 sets a charge number (spark number) n for charging the spark energy accumulating capacitor C2 for the first charge. In S107 the spark controller 24 begins charging the spark energy accumulating capacitor C2.

In S108 the spark controller 24 determines whether the specified charge time has elapsed. When the specified charge time has elapsed (S108: YES), then in S109 the spark controller 24 turns the discharge thyristor SCR1 on, induces a high voltage in the spark coil T2, and controls the spark plug 9 to generate a spark. In S110 the spark controller 24 increments the charge number n for charging the spark energy accumulating capacitor C2 (n=n+1). In S111 the spark controller 24 determines whether the charge number n has reached a preset number Sc.

If the spark controller 24 determines in S111 that the spark number n has not reached the preset number Sc (S111: NO), then in S113 the spark controller 24 determines whether the trigger 12 has not yet been turned off. If the trigger 12 has not yet been turned off (S113: NO), then the process returns to S107 and the spark controller 24 begins charging the spark energy accumulating capacitor C2.

However, if the spark controller 24 determines in S111 that the spark number n has reached the preset number Sc (S111: YES), then in S112 the spark controller 24 determines whether the trigger 12 has been turned off. If the trigger 12 has been turned off (S112: YES), then the spark controller 24 returns to the initial state.

Figure 8:
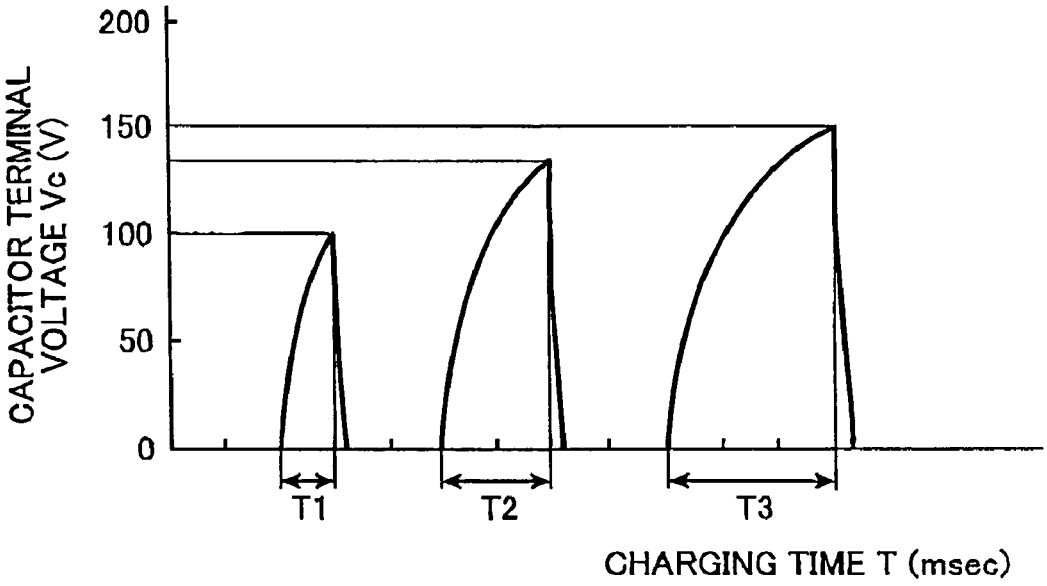
FIG. 8 is a graph showing a variation of the charge voltage waveform for the spark capacitor of the preferred embodiment.
Figure 9:
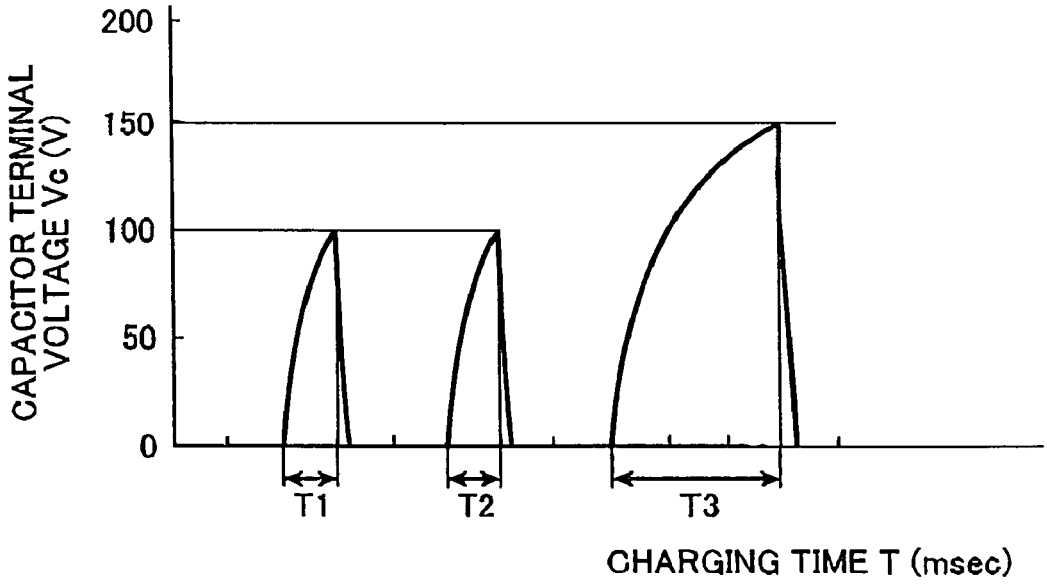
FIG. 9 is another variation of the charge voltage waveform for the spark capacitor of the preferred embodiment.
Figure 10:
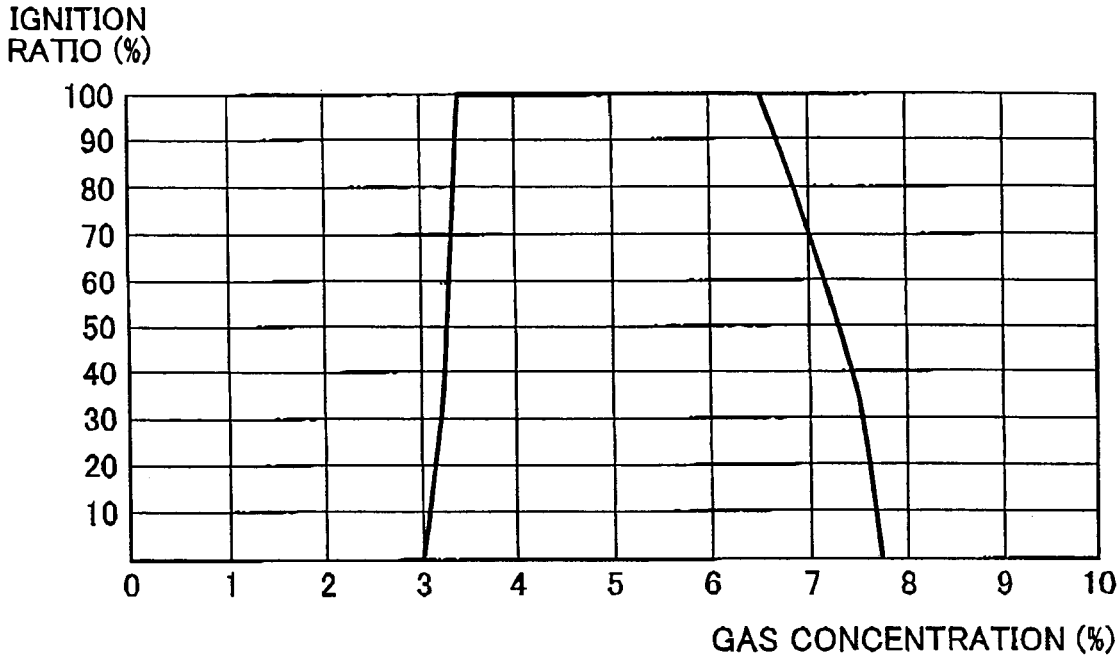
FIG. 10 is a graph showing the relationship of the ignition ratio and gas concentration for a conventional combustion-powered, fastener-driving tool.

In the preferred embodiment described above, the charging time for the three sparks is uniformly controlled as T1=T2=T3. However, the charging time may be varied for each spark. In the embodiment shown in FIG. 8, the charging time is controlled at progressively longer time lengths in the relationship T1<T2<T3. In the embodiment shown in FIG. 9, the charging time is controlled with a longer charging time for the final spark, as indicated by the relationship T1=T2<T3. By modifying the charging times in this way, it is possible to reduce the power consumption in the battery.

In the preferred embodiment described above, a plurality of sparks is generated in response to the operation o_ the trigger. However, if the ignition of burning of fuel gas by a spark generated in the middle of the plurality of sparks is detected, it is possible to cancel the generation of other sparks after this ignition period. For example, using the graph of temperatures and spark numbers shown in FIG. 6, if the third spark ignites and burns the fuel gas in the combustion chamber 15*a* when the spark number is set to seven times for a temperature of 5° C., the fourth and subsequent sparks can be cancelled. Here, the combustion-powered, fastener-driving tool is provided with a combustion sensor for detecting the ignition of fuel gas. The following are some examples of combustion sensors and their preferable locations in the combustion-powered, fastener-driving tool.

(1) A pressure sensor disposed in the combustion chamber 15*a* for detecting explosive combustion, (2) An accelerometer 247 disposed near the motor as shown in FIG. 3, which incurs vibrations by explosive combustion; and (3) A positional sensor, such as a photoelectric switch, for detecting the position of the driving blade 10*a*, which is moved by explosive combustion, disposed in a nose part of the fastener-driving tool through which the driving blade 10*a* is introduced in a downward direction.

Cancelling subsequent sparks after combustion is achieved is useful for extending the life of the battery.

While the invention has been described in detail with reference to specific embodiments thereof, it would be apparent to those skilled in the art that many modifications and variations may be made therein without departing from the spirit of the invention, the scope of which is defined by the attached claims.

What is claimed is:

1. A combustion-powered, fastener-driving tool comprising:

a housing;

a cylinder fixedly disposed in the housing;

a combustion chamber disposed on top of the cylinder, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated;

a piston movably supported in the cylinder and driven by combustion in the combustion chamber;

a driving blade coupled to the piston for driving a fastener;

a spark controller that generates a plurality of sparks in succession with the spark plug; and a temperature sensor that detects a tool temperature that is primarily increased by heat generated in the combustion chamber;

wherein the spark controller varies the number of sparks generated in the spark plug based on the temperature detected by the temperature sensor so as to provide at least one spark.

2. The combustion-powered, fastener-driving tool according to claim 1, wherein the spark controller varies the number of sparks so that when the tool temperature is lower than a predetermined level the number of sparks is set to be greater than the number of sparks when the tool temperature is higher than the predetermined level.

3. A combustion-powered, fastener-driving tool comprising:

a housing;

a cylinder fixedly disposed in the housing;

a combustion chamber disposed on top of the cylinder, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated;

a piston movably supported in the cylinder and driven by combustion in the combustion chamber;

a driving blade coupled to the piston for driving a fastener; and a spark controller that generates a plurality of sparks in succession with the spark plug;

wherein the spark controller controls the spark plug to generate a first predetermined number of sparks when the tool temperature is within a predetermined range, a second predetermined number of sparks when the tool temperature is lower than lowest temperature in the predetermined range, and a third predetermined number of sparks when the tool temperature is higher than highest temperature in the predetermined range, and wherein the second predetermined number and the third predetermined number are greater than the first predetermined number.

4. The combustion-powered, fastener-driving tool according to claim 3, wherein the second predetermined number of sparks is greater than the third predetermined number of sparks.

5. A combustion-powered, fastener-driving tool comprising:

a housing;

a cylinder fixedly disposed in the housing;

a combustion chamber disposed on top of the cylinder, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated;

a piston movably supported in the cylinder and driven by combustion in the combustion chamber;

a driving blade coupled to the piston for driving a fastener; and a spark controller that generates a plurality of sparks in succession with the spark plug;

wherein the spark controller comprises a spark capacitor charging circuit, and a spark energy accumulating capacitor connected to the spark capacitor charging circuit, the spark energy accumulating capacitor supplying energy to the spark plug to generate the spark, and wherein the spark capacitor charging circuit varies a charge time for charging the spark energy accumulating capacitor based on the number of sparks to be generated.

6. A combustion-powered, fastener-driving tool comprising:

a housing;

a cylinder fixedly disposed in the housing;

a combustion chamber disposed on top of the cylinder, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated;

a piston movably supported in the cylinder and driven by combustion in the combustion chamber;

a driving blade coupled to the piston for driving a fastener; and a spark controller that generates a plurality of sparks of at least two sparks in succession with the spark plug for combustion of the gaseous mixture;

wherein the spark controller comprises a combustion sensor that is disposed in the housing, detects occurrence of combustion of the gaseous mixture in the combustion chamber, and outputs a detection signal indicative of occurrence of combustion, and wherein the spark controller cancels the generation of the plurality of sparks with the spark plug when the combustion sensor outputs the detection signal.

7. The combustion-powered, fastener-driving tool according to claim 6, wherein the spark controller varies the number of sparks generated in the spark plug based on the temperature detected by the temperature sensor so as to provide at least one spark.

8. A combustion-powered, fastener-driving tool comprising:

a housing;

a cylinder disposed in the housing and extending vertically;

a piston vertically movably supported in the cylinder;

a driving blade coupled to the piston for driving a fastener;

a combustion chamber frame vertically slidably movable along the cylinder, a combustion chamber being formed on top of the cylinder by the combustion chamber frame and the piston, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated;

a spark controller that generates a plurality of sparks in succession with the spark plug; and a temperature sensor that detects a tool temperature that is primarily increased by heat generated in the combustion chamber;

wherein the spark controller varies the number of sparks generated in the spark plug based on the temperature detected by the temperature sensor so as to provide at least one spark.

9. The combustion-powered, fastener-driving tool according to claim 8, wherein the spark controller varies the number of sparks so that when the tool temperature is lower than a predetermined level the number of sparks is set to be greater than the number of sparks when the tool temperature is higher than the predetermined level.

10. A combustion-powered, fastener-driving tool comprising:

a housing;

a cylinder disposed in the housing and extending vertically;

a piston vertically movably supported in the cylinder;

a driving blade coupled to the piston for driving a fastener;

a combustion chamber frame vertically slidably movable along the cylinder, a combustion chamber being formed on top of the cylinder by the combustion chamber frame and the piston, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated; and a spark controller that generates a plurality of sparks in succession with the spark plug;

wherein the spark controller controls the spark plug to generate a first predetermined number of sparks when the tool temperature is within a predetermined range, a second predetermined number of sparks when the tool temperature is lower than lowest temperature in the predetermined range, and a third predetermined number of sparks when the tool temperature is higher than highest temperature in the predetermined range, and wherein the second predetermined number and the third predetermined number are greater than the first predetermined number.

11. The combustion-powered, fastener-driving tool according to claim 10, wherein the second predetermined number of sparks is greater than the third predetermined number of sparks.

12. A combustion-powered, fastener-driving tool comprising:

a housing;

a cylinder disposed in the housing and extending vertically;

a piston vertically movably supported in the cylinder;

a driving blade coupled to the piston for driving a fastener;

a combustion chamber frame vertically slidably movable along the cylinder, a combustion chamber being formed on top of the cylinder by the combustion chamber frame and the piston, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated; and a spark controller that generates a plurality of sparks in succession with the spark plug;

wherein the spark controller comprises a spark coil having a primary winding and a secondary winding to which the spark plug is connected, and a spark energy accumulating capacitor connected to the primary winding of the spark coil for supplying energy to the spark plug to generate the spark, and wherein charging time of the spark energy accumulating capacitor is varied depending on the number of sparks to be generated.

13. A combustion-powered, fastener-driving tool comprising:

a housing;

a cylinder disposed in the housing and extending vertically;

a piston vertically movably supported in the cylinder;

a driving blade coupled to the piston for driving a fastener;

a combustion chamber frame vertically slidably movable along the cylinder, a combustion chamber being formed on top of the cylinder by the combustion chamber frame and the piston, the combustion chamber accommodating a gaseous mixture of existing air in the combustion chamber and fuel injected therein;

a spark plug that is disposed in the combustion chamber and generates a spark to combust the gaseous mixture in the combustion chamber;

a trigger that produces the spark in the spark plug when operated; and a spark controller that generates a plurality of sparks of at least two sparks in succession with the spark plug for combustion of the gaseous mixture;

wherein the spark controller comprises a combustion sensor that is disposed in the housing, detects occurrence of combustion of the gaseous mixture in the combustion chamber, and outputs a detection signal indicative of occurrence of combustion, and wherein the spark controller cancels the generation of the plurality of sparks with the spark plug when the combustion sensor outputs the detection signal.

14. The combustion-powered, fastener-driving tool according to claim 13, wherein the spark controller varies the number of sparks generated in the spark plug based on the temperature detected by the temperature sensor so as to provide at least one spark.

* * * * *

UNITED STATES PATENT AND TRADEMARK OFFICE

CERTIFICATE OF CORRECTION

PATENT NO. : 7,467,739 B2
APPLICATION NO. : 11/237860
DATED : December 23, 2008
INVENTOR(S) : Fujisawa et al.

It is certified that error appears in the above-identified patent and that said Letters Patent is hereby corrected as shown below:

Title page Insert

-- (30) Foreign Application Priority Data

Sept. 29, 2004 (JP) 2004-284101 --

Signed and Sealed this

Twelfth Day of May, 2009

JOHN DOLL
*Acting Director of the United States Patent and Trademark Office*